US009188294B1

(12) United States Patent
Wegner et al.

(10) Patent No.: US 9,188,294 B1
(45) Date of Patent: Nov. 17, 2015

(54) LED-BASED OPTICALLY INDIRECT RECESSED LUMINAIRE

(71) Applicants: Scott David Wegner, Peachtree City, GA (US); Jose Antonio Laso, Newman, GA (US); Christopher Michael Bryant, Social Circle, GA (US)

(72) Inventors: Scott David Wegner, Peachtree City, GA (US); Jose Antonio Laso, Newman, GA (US); Christopher Michael Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 345 days.

(21) Appl. No.: 13/746,643

(22) Filed: Jan. 22, 2013

Related U.S. Application Data

(60) Provisional application No. 61/588,977, filed on Jan. 20, 2012.

(51) Int. Cl.
*F21S 8/02* (2006.01)

(52) U.S. Cl.
CPC ..... *F21S 8/026* (2013.01)

(58) Field of Classification Search
CPC ..... F21V 21/04; F21V 21/30
USPC ..... 362/147, 148, 150, 364, 235, 373, 294
See application file for complete search history.

(56) References Cited

U.S. PATENT DOCUMENTS

| | | | | |
|---|---|---|---|---|
| 5,034,864 | A * | 7/1991 | Oe | 362/224 |
| 5,509,223 | A * | 4/1996 | Jung | 40/564 |
| 8,905,575 | B2 * | 12/2014 | Durkee et al. | 362/218 |
| 2004/0160757 | A1 * | 8/2004 | Kuo | 362/31 |
| 2005/0117333 | A1 * | 6/2005 | Yoshida et al. | 362/147 |
| 2006/0152921 | A1 * | 7/2006 | Welker | 362/147 |
| 2007/0253205 | A1 * | 11/2007 | Welker | 362/373 |
| 2011/0043132 | A1 * | 2/2011 | Kim et al. | 315/294 |
| 2012/0051041 | A1 * | 3/2012 | Edmond et al. | 362/231 |
| 2012/0140461 | A1 * | 6/2012 | Pickard | 362/225 |

* cited by examiner

*Primary Examiner* — Ali Alavi
(74) *Attorney, Agent, or Firm* — King & Spalding LLP

(57) ABSTRACT

A light emitting diode (LED)-based optically indirect luminaire includes a reflector that receives light generated by an LED light source platform and reflects the light beyond the platform into a space to be illuminated. The LED light source platform can be configured as a pendant that is suspended from the reflector by one or more supports or cables. The LED light source platform can include a heat sink that receives the LEDs and the printed circuit board (PCB) they are disposed upon so that the LEDs are visible to the reflector and hidden from view. An optional lens can be included that covers the LEDs and PCB to protect them from dust and moisture.

20 Claims, 10 Drawing Sheets

LED-BASED OPTICALLY INDIRECT RECESSED LUMINAIRE

RELATED APPLICATIONS

The present application claims priority to U.S. Provisional Patent Application No. 61/588,977, filed Jan. 20, 2012, and titled "LED-Based Optically Indirect Recessed Luminaire," the entire contents of which is incorporated herein by reference.

TECHNICAL FIELD

Embodiments described herein relate generally to lighting solutions, and more particularly to systems, methods, and devices for providing a light emitting diode (LED) light fixture.

BACKGROUND

Indirect lighting methods are used with a number of different fixtures. In a number of cases, indirect lighting is achieved by using an architectural coffer with a lighting pendant (also called a light source) that hangs underneath and directs light toward the architectural coffer. The light reflects off the coffer toward the space away from the architectural coffer. With the popularity of LEDs, LED-based lighting fixtures may be used for indirect lighting applications.

BRIEF DESCRIPTION OF THE DRAWINGS

Reference will now be made to the accompanying drawings, which are not necessarily drawn to scale, and wherein.

SUMMARY

Figure 1A:
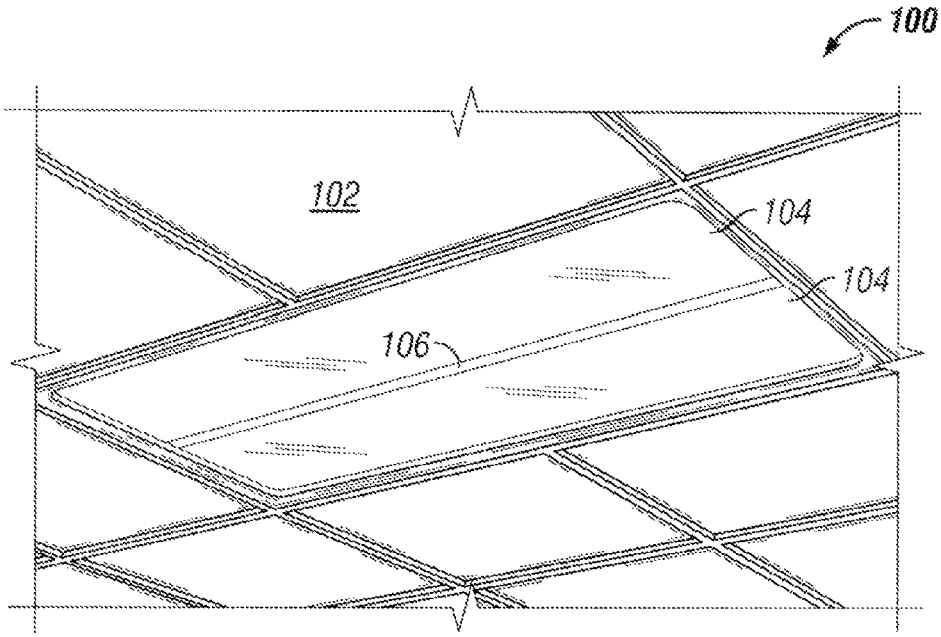
FIGS. 1A through 1C each show a perspective view of an LED-based optically indirect recessed luminaire in accordance with one or more particular embodiments.

A light emitting diode (LED)-based optically indirect luminaire may be a direct luminaire recessed into a surface (e.g., a ceiling) and generating an optically indirect light to emulate an architectural coffer/luminaire system. An LED-based optically indirect luminaire includes a reflector that receives light generated by an LED light source platform and reflects the light beyond the platform into a space to be illuminated. The LED light source platform can be configured as a pendant that is suspended from the reflector by one or more supports or cables. The LED light source platform can include a heat sink that receives the LEDs and the printed circuit board they are disposed upon so that the LEDs are visible to the reflector and hidden from view. An optional lens can be included that covers the LEDs and PCB to protect them from dust and moisture.

In a particular embodiment, an LED-based optically indirect luminaire includes a reflector recessed into a ceiling. The LED-based optically indirect luminaire also includes an LED light source platform that is disposed below a portion of the reflector and that extends along a longitudinal axis of the reflector. The LED light source platform includes a plurality of LEDs disposed on the LED light source platform. The LED light source platform shields the LEDs from view with respect to a space to be illuminated by the LED-based optically indirect luminaire. Substantially all of the light emitted by the plurality of LEDs is directed toward the reflector.

In another particular embodiment, an LED-based optically indirect luminaire includes a reflector recessed into a ceiling. The LED-based optically indirect luminaire also includes an LED light source platform that is disposed below a portion of the reflector and that extends along a longitudinal axis of the reflector. The LED light source platform includes a printed circuit board (PCB), a plurality of LEDs disposed on the PCB, and a heat sink coupled to the PCB. The heat sink and the PCB shield the plurality of LEDs from view with respect to area below the LED-based optically indirect luminaire.

In another particular embodiment, an LED-based optically indirect luminaire includes a reflector recessed into a ceiling. The LED-based optically indirect luminaire also includes an LED light source platform that is disposed below a portion of the reflector and that extends along a longitudinal axis of the reflector. The LED light source platform includes a plurality of LEDs disposed on the LED light source platform. The LED-based optically indirect luminaire further includes a housing. The reflector is attached to the housing via a hinge and is configured to swing at the hinge.

These and other aspects, features, and embodiments will become apparent to a person of ordinary skill in the art upon consideration of the following detailed description of illustrated embodiments.

DETAILED DESCRIPTION OF EXAMPLE EMBODIMENTS

The example embodiments discussed herein are directed to LED-based optically indirect luminaires. Specifically, particular embodiments may be directed to a direct luminaire recessed into a surface (e.g., a ceiling) and generating an optically indirect light to emulate an architectural coffer/luminaire system. While generally described herein as being optically indirect recessed luminaires, it should be understood that each of the embodiments described herein are not limited to indirect lighting and/or recessed configurations. Further, the embodiments may be configured to replace non-LED-based fixtures that are used for indirect lighting and/or recessed applications. Further, the LED arrays described herein may include any type of LED technology, including, but not limited to, chip on board and discrete die. Each LED array may be configured as one or more linear strips (rows) of LEDs.

Further, particular embodiments of the LED-based optically indirect recessed luminaires may include a lens, door, panel, cover and/or any other similar protection or enclosure element. For example, a clear lens may be placed over the entire bottom aperture to seal and/or cover at least a portion of the luminaire for one or more of a number of reasons (e.g., reduce dust, reduce vandalism, decrease contamination in food prep areas, maintain a clean room environment in a clean room or a medical facility, meet explosion-proof standards). The clear lens, with smooth surfaces, will reflect light from around a space in which the luminaire is located. Because of the high luminance of the luminaire surfaces, these reflections will be virtually impossible to see. In such a case, an observer would likely not be able to discern the difference with or without a lens.

In certain particular embodiments, the luminaires generate a luminous gradient over the reflector, brightest at the top and dimmest at the perimeter of the bottom aperture. In one or more particular embodiments, the luminaire eliminates the perception of glare. The LED-based optically indirect recessed luminaire can include a reflective element that reflects light generated by one or more LED arrays. The particular embodiments described herein may provide several advantages including, but not limited to, increasing efficiency of the luminaire and increasing customer satisfaction by providing a uniform light emission from the luminaire. Further, one or more embodiments described herein may provide a natural air cooling mechanism to increase the efficiency and lifespan of the LED light source platform of the LED-based optically indirect luminaire.

Example embodiments of an LED-based optically indirect recessed luminaires now will be described more fully hereinafter with reference to the accompanying drawings, in which particular embodiments of LED-based optically indirect recessed luminaires are shown. LED-based optically indirect luminaires may, however, be embodied in many different forms and should not be construed as limited to the example embodiments set forth herein; rather, these embodiments are provided so that this disclosure will be thorough and complete, and will fully convey the scope of LED-based linear indirect luminaires to those or ordinary skill in the art. Like, but not necessarily the same, elements (also sometimes called components) in the various figures are denoted by like reference numerals for consistency.

FIG. 1A shows a perspective view of an LED-based optically indirect recessed luminaire 100 in accordance with a particular embodiment. A reflector 104 of the luminaire 100 can be recessed or have a significant portion recessed into a ceiling 102. Alternatively, the reflector 104 as well as other portions of the luminaire 100 may be positioned below the ceiling 102, either by being attached to the ceiling 102 or suspended from the ceiling 102. The term ceiling 102 herein is used in a very broad sense and is intended to not only include a traditional overhead ceiling surface but may be any wall, floor, or surface in any plane (vertical, horizontal, diagonal) or three-dimensional space. The dimensions (length, width, curvature) of the reflector 104 may vary, depending on one or more factors including, but not limited to, the configuration of an LED light source platform 106, the location of the LED light source platform 106 relative to the reflector 104, the type of LEDs on the LED light source platform 106, the overall lumen output of the LEDs on the LED light source platform 106, and the desired lighting effects of the LED-based optically indirect luminaire 100.

In one or more particular embodiments, bottom aperture (i.e., the opening surrounded by the perimeter along the bottom) of the reflector 104 has a substantially rectangular or square shape. In one or more alternative embodiments, the bottom aperture of the reflector 104 is circular, oval, or otherwise rounded or curved. Further, additional equipment may be placed adjacent to a corner of the bottom aperture of the reflector 104. Examples of such additional equipment may include, but are not limited to, an occupancy sensor, a photocell, a communication hub, a task light, an accent light, a wall washer, an emergency light, a camera, a speaker, and an air handling grill. However, other shapes for the reflector 104 (including the bottom aperture) are contemplated within the scope and spirit of this disclosure. The bottom aperture of the reflector 104 may be integrated with an aperture in the ceiling 102. The bottom aperture of the reflector 104 may be flush with or offset from the aperture in the ceiling 102.

In one or more particular embodiments, the bottom aperture of the reflector 104 is kept as luminous as possible while minimizing an extreme luminous gradient. For example, the reflector 104 may be oriented such that each portion of the surface of the reflector 104 is normal (i.e., at right angle) relative to the LED light source platform 106. In one or more particular embodiments, the profile of the surface of the reflector 104 is substantially similar to an ellipse. Such an elliptical or dome-like profile of the reflector 104 may improve the ease and/or cost of manufacturing the reflector 104.

In a particular embodiment, a top portion or another portion of the reflector 104 may be coupled to an object (e.g., a housing or a ceiling support). For example, the reflector 104 (as well as some or all of the other components of the luminaire 100) may be coupled to a housing that surrounds at least a portion of the reflector 104, where the housing is disposed within an aperture in the ceiling 102. Alternatively, the reflector 104 may be coupled directly to the ceiling 102 (or to one or more elements located behind the ceiling 102), where the bottom aperture of the reflector 104 is adjacent to an aperture in the ceiling 102. The reflector 104 may be coupled to an object (e.g., a housing or a ceiling support) using one or more methods, including but not limited to epoxy, mating threads, and fastening devices.

The reflector 104 may be a diffuse reflector or a specular reflector. In the case of a diffuse reflector, the reflector 104 may blend the light from the individual LED sources, mixing colored lights from different LEDs that have small color variations from one LED to another. The diffuse reflector 104 may also mix different color LEDs together for red-green-blue and/or white+red LED strategies.

Figure 2A:
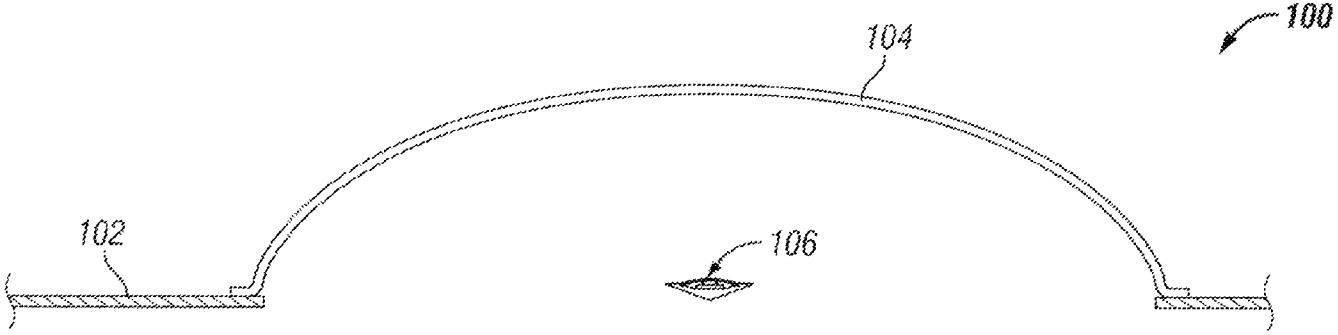
FIG. 2A through 2E show various views of an LED-based optically indirect recessed luminaire in accordance with one or more particular embodiments.
Figure 2B:
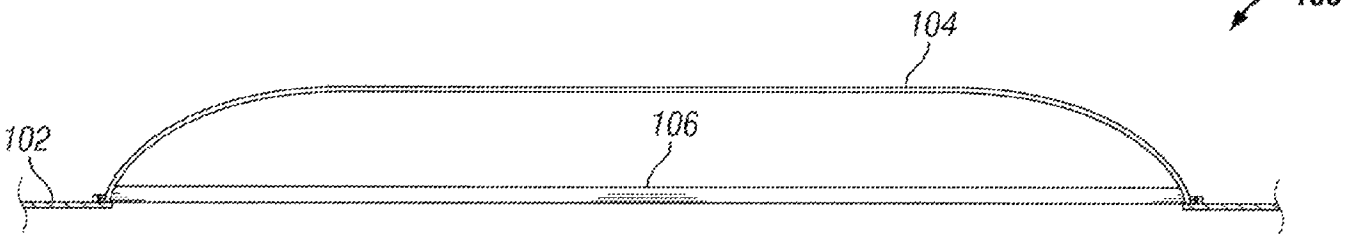
Figure 2C:
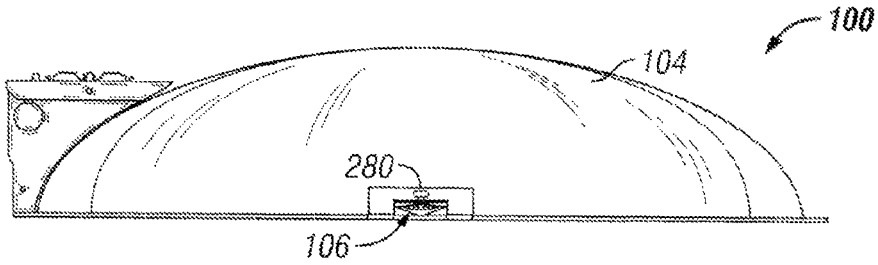
Figure 2D:
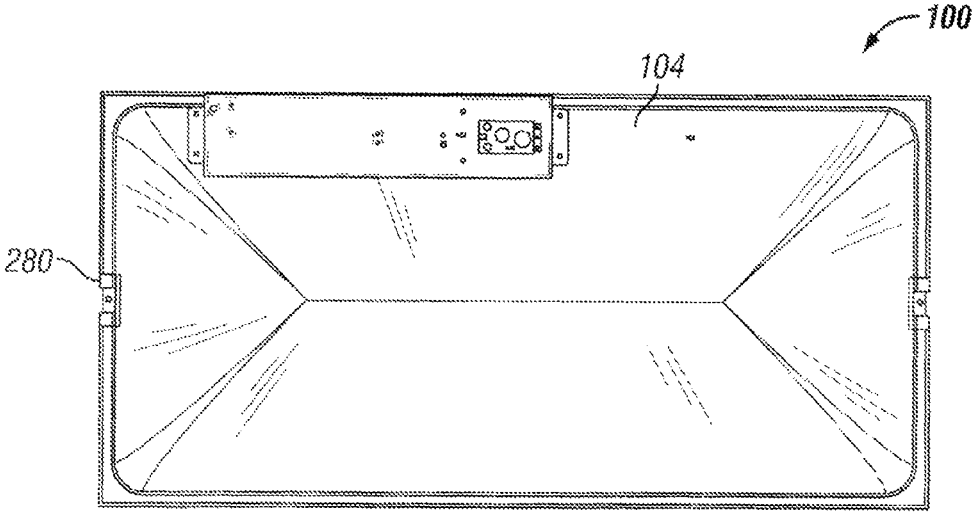
Figure 2E:
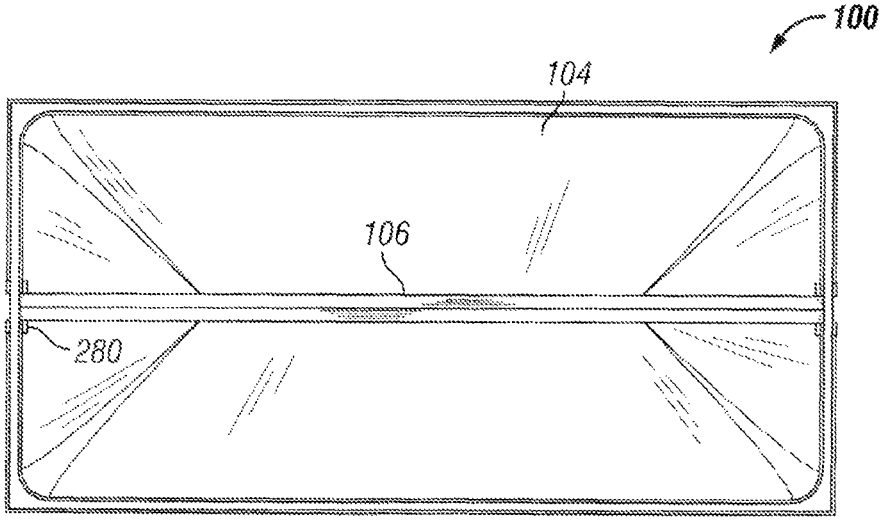

In a particular embodiment, the LED light source platform 106, described more fully with respect to FIG. 3A below, is coupled to each longitudinal end of the reflector 104, as shown in FIGS. 1A, 2B, and 2E. In such a case, the LED light source platform 106 may be coupled to the longitudinal ends of the reflector 104 in one or more ways, including but not limited to fastening devices, slotted fittings, and mating threads. Electrical power and/or control connections to the LED light source platform 106 may be provided through one or both couplings.

Alternatively, or in addition, the LED light source platform 106 may hang from (may be suspended by) the reflector 104 using one or more supports 108, as shown, for example, in FIGS. 1B, 1C, 2F, and 2G. In such a case, the LED light source platform 106 may be referred to as a pendent. Each support 108 may be fixed or flexible. The support 108 may be made of one or more of any suitable material including, but not limited to, aircraft cable, metallic or non-metallic wire, metal, glass, and plastic. In addition to supporting the LED light source platform 106, the support 108 may also be used as a conduit to provide electrical power and/or control connections to the LED light source platform 106. When one or more supports 108 are used, the characteristics (e.g., placement, thickness) of the support 108 may be determined in such a way as to reduce the effects of shadows created by the support 108.

Figure 1B:
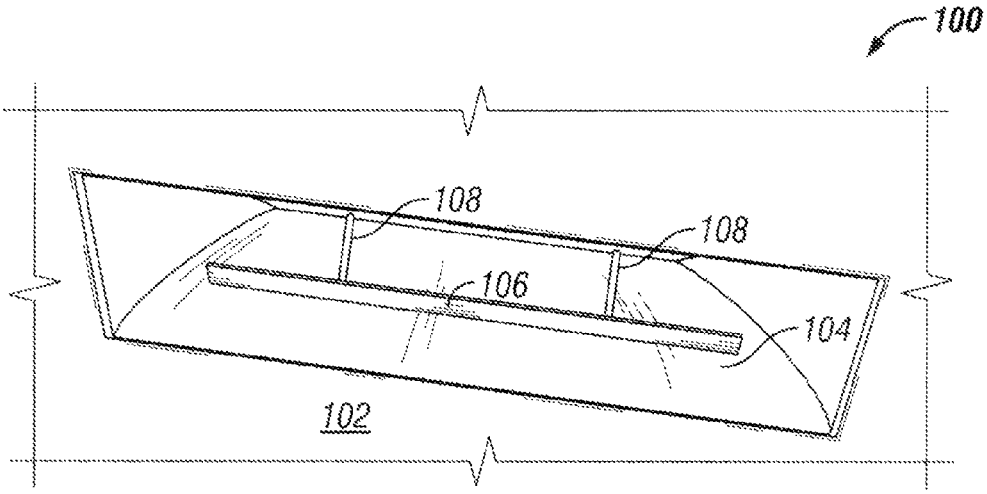
Figure 1C:
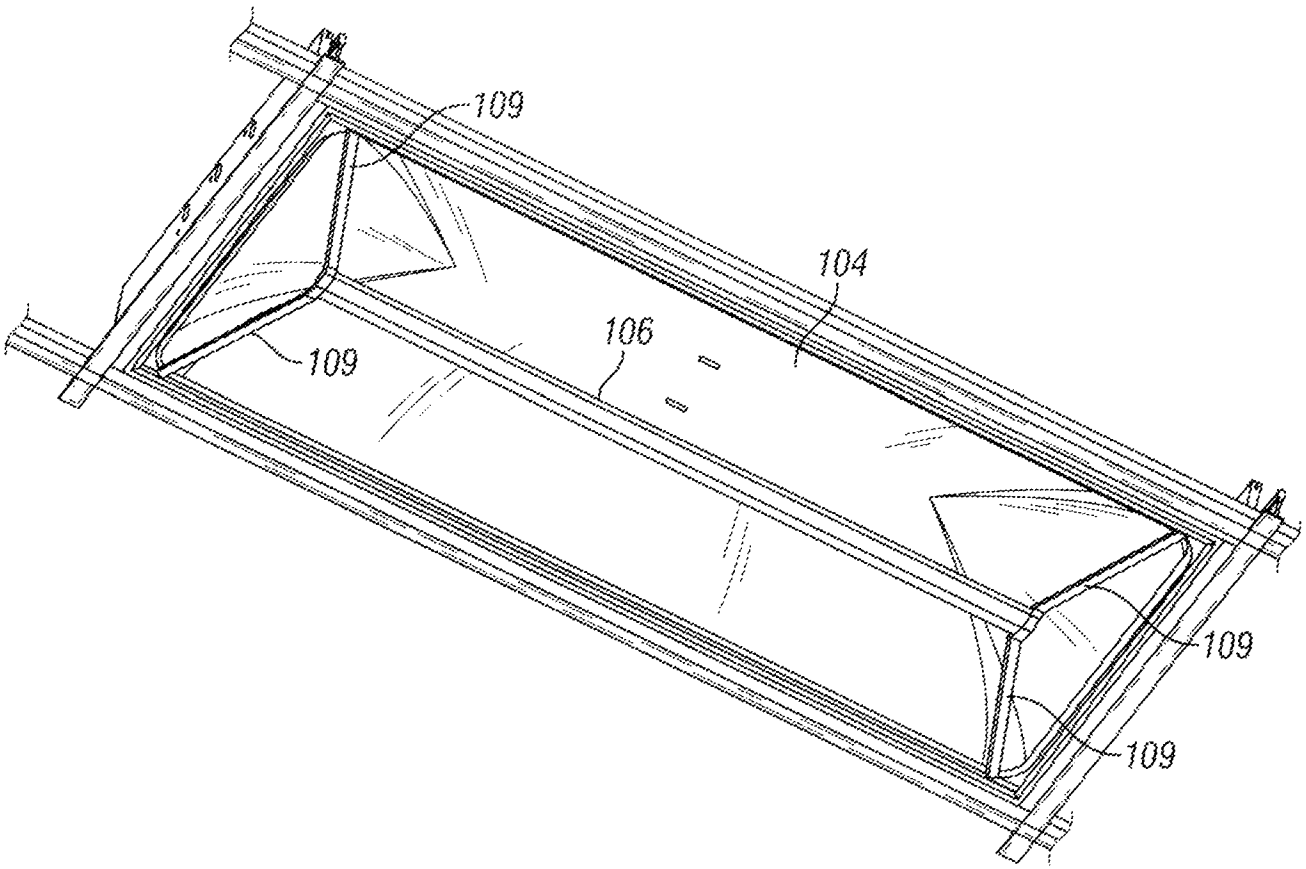

The supports 108 may be substantially vertical to support the LED light source platform 106 from the top portion of the reflector 104, as shown in FIG. 1B. Alternatively, the supports 109 may be substantially horizontal to support the LED light source platform 106 from the bottom portion (perimeter along the bottom) of the reflector 104, as shown in FIG. 1C.

The LED light source platform 106 may be positioned in one of a number of orientations relative to the bottom aperture of the reflector 104, including but not limited to substantially parallel with the bottom aperture of the reflector 104. The LED light source platform 106 may also be positioned even with, above, or below the bottom aperture of the reflector 104. For example, as shown in FIG. 2A, the LED light source platform 106 may be placed slightly above the center of the ellipse formed by the reflector 104 when viewed cross-sectionally from the side of the LED-based optically indirect luminaire 100. Further, as shown in FIG. 2B, as the LED light source platform 106 traverses the length of the reflector 104 and couples to each longitudinal end of the reflector 104, the LED light source platform 106 is horizontally positioned slightly above the bottom aperture of the reflector 104.

FIG. 2C shows a cross-sectional end view of the LED-based indirect recessed luminaire 100 shown in FIGS. 2A and 2B. Specifically, a support bracket 280, mounted approximately in the middle of the width portion of the bottom aperture of the reflector 104, is shown in FIG. 2C. In one or more particular embodiments, the support bracket 280 is configured to couple to and secure an end of the LED light source platform 106. Specifically, the support bracket 280 may couple to one or more elements (e.g., heat sink, printed circuit board) of the LED light source platform 106. FIG. 2D shows a transparent top view and FIG. 2E shows a bottom view of the LED-based indirect recessed luminaire 100 of FIGS. 2A through 2C, featuring the support bracket 280.

Figure 2F:
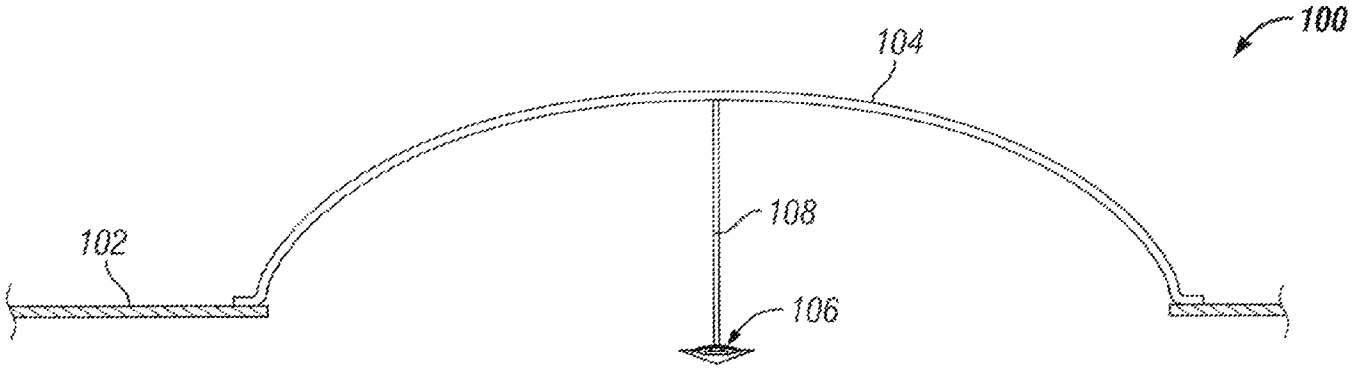
FIGS. 2F and 2G show various views of an LED-based optically indirect recessed luminaire in accordance with one or more particular embodiments.
Figure 2G:
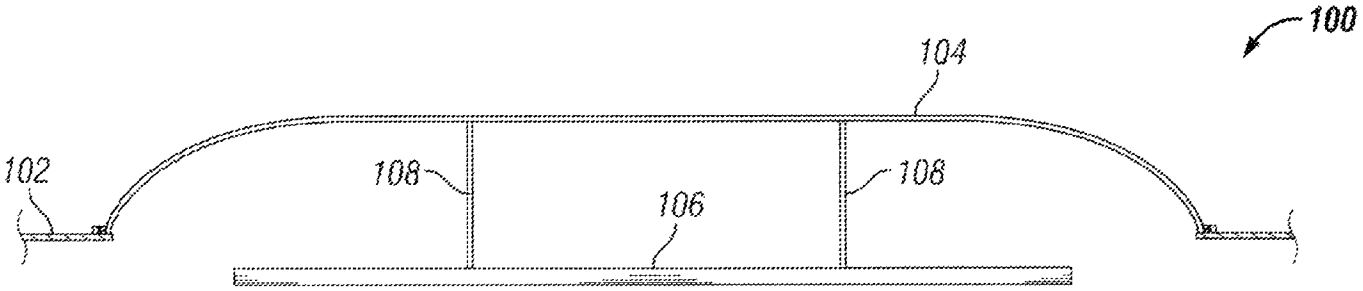

As another example, as shown in FIG. 2F, the LED light source platform 106 may be placed slightly below the center of the ellipse formed by the reflector 104 when viewed cross-sectionally from the side of the LED-based optically indirect luminaire 100. Further, as shown in FIG. 2G, as the LED light source platform 106 is suspended using supports 108 and traverses approximately ⅔ the length of the reflector 104, the LED light source platform 106 is horizontally positioned slightly below the bottom aperture of the reflector 104.

The position of the LED light source platform 106 relative to the bottom aperture (vertically and/or horizontally) of the reflector 104 may be based on one or more of a number of factors, including but not limited to aperture opening (discussed below with respect to FIG. 6), line of sight (discussed below with respect to FIG. 7), dimensions (e.g., length, width, height) of the LED light source platform 106, curvature of the inner surface of the reflector, shape of the heat sink, positioning of LEDs on the LED light source platform 106, and whether supports 108 are used to support the LED light source platform 106.

The dimensions of the LED light source platform 106 may vary. For example, as shown in FIGS. 2A and 2C, the width of the LED light source platform 106 may be substantially less than the width of the bottom aperture of the reflector 104. For example, the width of the LED light source platform 106 may be approximately 1.6 inches, where the width of the bottom aperture of the reflector 104 may be approximately 24 inches. Further, the length of the LED light source platform 106 may vary. For example, as shown in the cross-sectional side view of the LED-based optically indirect luminaire 100 of FIGS. 2B and 2E, the LED light source platform 106 may have a length that is substantially equal to the length portion of the bottom aperture of the reflector 104. As another example, as shown in the cross-sectional side view of the LED-based optically indirect luminaire 100 of FIG. 2G, the LED light source platform 106 may have a length that is less (in this case, approximately ⅓ less) than the length of the bottom aperture of the reflector 104. For example, the length of the LED light source platform 106 may be 33 inches, where the length of the bottom aperture of the reflector 104 is about four feet.

Figure 3A:
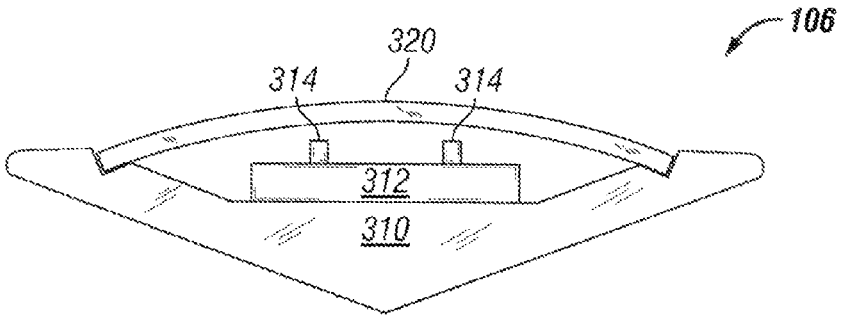
FIG. 3A shows a cross-sectional end view of an LED light source platform in accordance with another particular embodiment.

FIG. 3A shows a cross-sectional end view of an LED light source platform 106 in accordance with one or more particular embodiments. As shown in FIG. 3A, the LED light source platform 106 includes a number of LEDs 314 mounted on a printed circuit board (PCB) 312, which is mounted on a heat sink 310. The LEDs 314 may be in one or more linear rows. For example, the LEDs 314 may run continuously along the full length of the LED light source platform 106 or a shorter portion of the length of the LED light source platform 106. In a particular embodiment, the LEDs 314 may be clustered in one or more concentrated spaces along the length of the LED light source platform 106.

In one or more particular embodiments, the LEDs 314 may not be mounted on a PCB 312. For example, the LEDs 314 may be discrete LEDs mounted on "star boards." In an alternative embodiment, the LEDs 314 may be a series of chip-on-board packages.

The particular embodiment shown in FIG. 3A has the heat sink 310 positioned approximately in the center of the luminaire. In alternative embodiments, the heat sink 310 may be positioned at some position offset from the center of the luminaire. For example, the heat sink 310 may be offset from the center of a wallwash luminaire that has an asymmetric pattern. Further, the LEDs 314 may be positioned along the approximate center of the length of the heat sink 310 and/or offset from the center of the length of the heat sink 310. For example, some of the LEDs 314 may be positioned along the approximate center of the length of the heat sink 310, and some other of the LEDs 314 may be offset from the center of the length of the heat sink 310.

In one or more particular embodiments, the LEDs 314 are positioned along approximately the middle two-thirds of the length of the PCB 312 and/or heat sink 310 bottom aperture of the reflector of the LED-based optically indirect recessed luminaire 100. For a given length of heat sink 310, the LEDs 314 may be placed on the PCB 312 in such a way as to minimize hot spots on the ends of the LED-based optically indirect luminaire 100. For example, each strip of LEDs may run for 33 inches for a reflector 104 and a heat sink 310 each having a length of approximately four foot. Each strip of LEDs may have any length up to the length of the bottom aperture of the reflector 104. The LED light source platform 106 may be made of one or more suitable materials, including but not limited to plastic and metal.

The PCB 312 is configured to receive and be electrically coupled to the LEDs 314. The PCB 312 may further be configured to provide power and control to the LEDs 314. The length of the PCB 312 may be less than or equal to the length of the heat sink 310 and/or greater than or equal to the span of the LEDs 314. The LEDs 314 may be positioned along or close to the middle of the PCB 312 along the length of the PCB 312. Each strip of LEDs on the PCB 312 may also include a single, double, triple or more rows of LEDs either aligned or offset with one-another and extending along the longitudinal axis of the LED light source platform. Alternatively, multiple printed circuit boards, such as the PCB 312, can be disposed on the heat sink 310, each having one or more rows of LEDs that span all or a portion of the LED light source platform 106. Each PCB 312 can contain LEDs 314 having the same light output wavelength or different light output wavelengths in order to individually control the intensity and color of the overall light output for the luminaire 100.

In one or more particular embodiments, the heat sink 310 is configured to hide the LEDs 314 from view from outside the LED-based optically indirect recessed luminaire 100. The heat sink 310 may also be configured to allow the LEDs to direct light toward one or more portions of a reflector, such as the reflector 104 of FIG. 2A. In so doing, shadow bands, such as shadow bands that may occur at the bottom aperture of the reflector, may be minimized. The shape of the heat sink 310 may depend on one or more factors, including but not limited to the aperture opening (i.e., the distance from the LED-based optically indirect recessed luminaire that the reflected light reaches) and the height of the LEDs above the line of sight (i.e., the distance that the LEDs 314 extend above the top of the heat sink 310 when looking at the LED light source platform 106 from a side view.) In one or more embodiments, the line of sight between the top-most portion of the LEDs 314 and the bottom aperture of the reflector defines the top portion of the heat sink 310.

The heat sink 310 may be made of one or more of a number of materials, including but not limited to plastic, sheet metal, and aluminum. The heat sink 310 may have a decorative covering along the bottom side (the side exposed to view). Further, the top side of the heat sink 310 may be coated with a reflective (e.g., diffuse, specular) material. The bottom side of the heat sink 310 may also have the same or different reflective coating as the coating on the top side. Such a reflective material on the bottom side of the heat sink 310 may make the heat sink 310 appear luminous and/or reduce the distinction between the heat sink 310 and other unlit areas of the luminaire 100. Some or all of the reflective coating may also be a decorative coating.

In one or more particular embodiments, the heat sink 310 traverses at least a portion of the reflector. For example, with respect to FIG. 2B, the heat sink 310 may traverse substantially the entire length of the bottom aperture of the reflector 104 and couple to each longitudinal end of the reflector 104. As another example, with respect to FIG. 2G, the heat sink 310 may be of a length shorter than the length of the bottom aperture of the reflector 104. In such a case, supports (such as the supports 108 may be used to suspend the heat sink 310 (as well as the other components of the LED light source platform 106).

In one or more particular embodiments, an optional lens 320 is provided to cover the LEDs 314 and the PCB 312. The lens 320 may be one or more of different types of material that manipulates light, including but not limited to a diffuser, a prismatic optic, a surface with remote phosphors, and a surface that includes quantum dots. The lens 320 may also serve as a dust cover for the LEDs 314, PCB 312, and top portion of the heat sink 310.

Figure 3B:
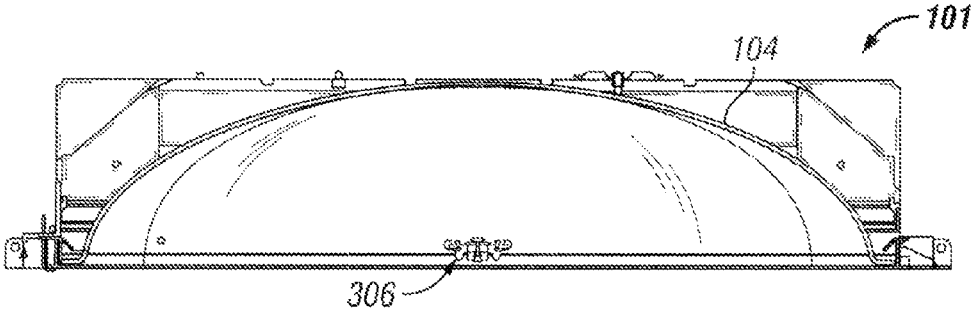
FIGS. 3B and 3C show an LED light source platform in accordance with another particular embodiment.
Figure 3C:
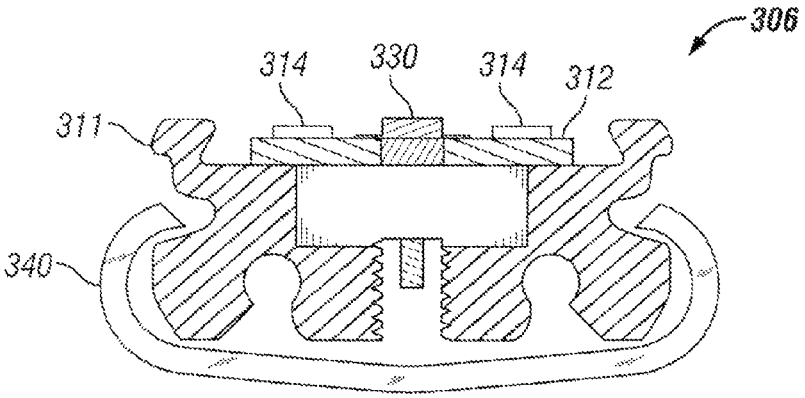

In one or more particular embodiments, the profile of the heat sink can have one or more shapes, including but not limited to v-shaped (as shown in FIG. 2), rounded, rectangular, and squared. For example, FIGS. 3B and 3C show an LED light source platform 306 that includes a heat sink 311 with a number of protrusions. In this example, the top of the heat sink 311 is shaped to receive a fastening device 330 that traverses the PCB 312 holding two rows of LEDs 314, with one row of LEDs on either side of the fastening device 330. The fastening device 330 may be any suitable fastening device to couple the PCB 312 to the heat sink 311, including but not limited to a rivet, a screw, and a snap. By coupling to the heat sink 311, the PCB 312 may receive power and/or control signals to properly operate.

In addition, the sides of the heat sink 311 are configured to receive a cover 340. The cover 340 may be configured to couple to the heat sink 311 in one or more ways, including but not limited to snapping into a slot (as shown in FIG. 3C) on either side of the heat sink 311, using an epoxy, using a fastening device, and using a clip. The cover 340 may be easily changed by a user. The cover 340 may be used for aesthetic purposes and may be available in one or more shapes and/or colors.

Figure 3D:
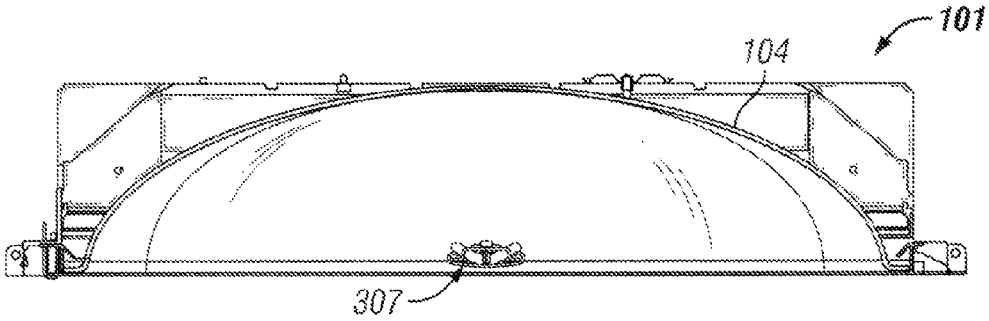
FIGS. 3D and 3E show an LED light source platform in accordance with another particular embodiment.
Figure 3E:
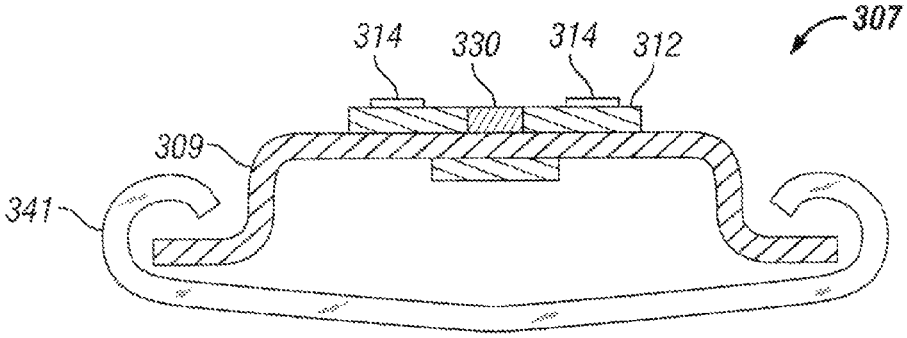

As another example of an alternative shape for a heat sink, FIGS. 3D and 3E show an LED light source platform 307 with a heat sink 309 that has a relatively streamlined profile. The top of the heat sink 309 is shaped to receive a fastening device 330 that traverses the PCB 312 holding two rows of LEDs 314, with one row of LEDs on either side of the fastening device 330. In addition, the sides of the heat sink 309 are configured to receive a cover 341. As above, the cover 341 may be configured to couple to the heat sink 309 in one or more of a number of ways. Further, the covers 340 and 341 may be easily changed by a user.

Figure 3F:
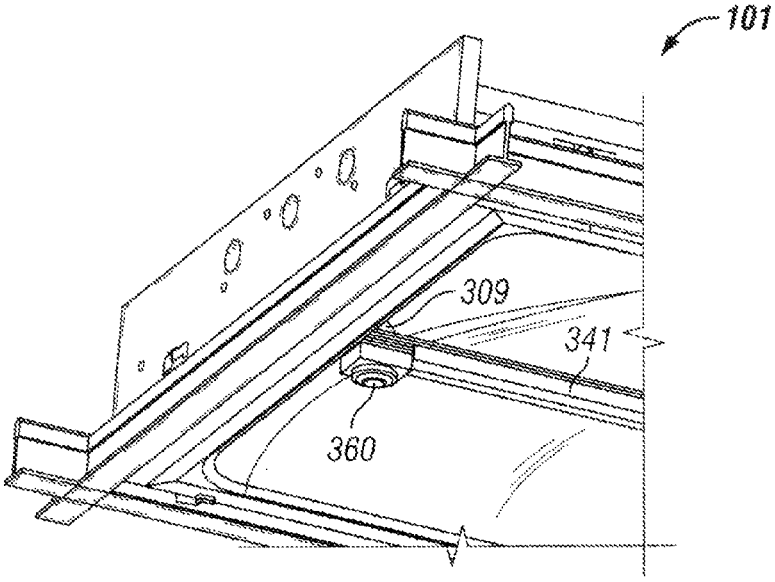
FIG. 3F shows an LED light source platform with a sensing device in accordance with an alternative embodiment.

In one or more particular embodiments, as shown in FIG. 3F, a sensing device 360 may be coupled to a portion of the LED light source platform. In this example, sensing device 360 is coupled to the under side of the heat sink 309 on one end. The sensing device 360 may be coupled to the heat sink 309 using the same or a different way than the manner in which the PCB couples to the top side of the heat sink 309. By coupling to the heat sink 309, the sensing device 360 may receive power and/or control signals to properly operate. Although FIG. 3F shows one sensing device 360, in alternative embodiments, more than one sensing device 360 may be coupled to the LED light source platform at one time. A sensing device 360 may be coupled to the LED light source platform at any point along the LED light source platform.

The sensing device 360 may be any device, whether related to operation of the LED-based indirect recessed luminaire 101 or not. Examples of a sensing device 360 may include, but are not limited to, a daylight sensor, a motion detector, a camera, and a noise sensor. The length of the cover 341 may be adjustable and/or cut to accommodate each sensing device 360 on the LED light source platform.

Figure 4:
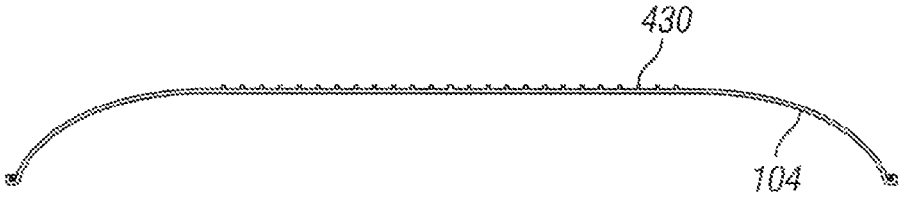
FIG. 4 shows a cross-sectional side view of a reflector in accordance with another particular embodiment.

FIG. 4 shows a cross-sectional side view of a reflector 104 in accordance with one or more particular alternative embodiments. Specifically, the reflector 104 includes a number of vertically protruding structural ribs 430 disposed along the top (outer) surface of the reflector 104. Such structural ribs 430 increase the structural integrity of the reflector 104. Alternatively, or in addition, the structural ribs 430 may be used to dissipate heat energy absorbed by the reflector 104 more quickly.

Figure 5:
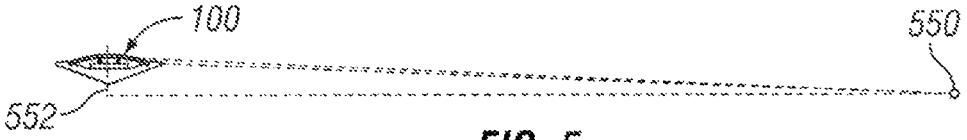
FIGS. 5 and 6 each show a cross-sectional side view of an LED light source platform to illustrate an aperture opening and a line of sight, respectively, in accordance with one or more alternative embodiments.
Figure 6:
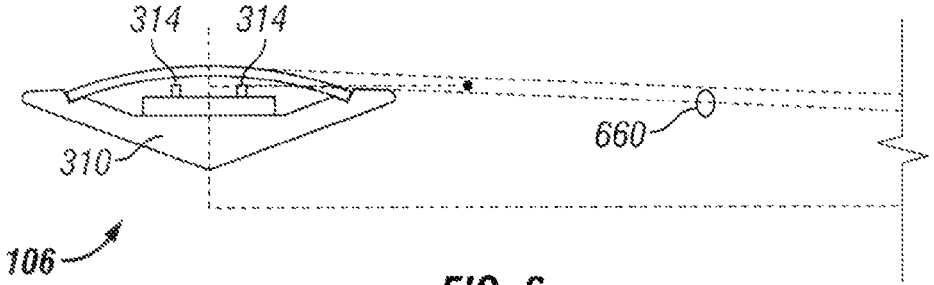

FIGS. 5 and 6 each show a cross-sectional side view of an LED light source platform to illustrate an aperture opening 550 and a line of sight 660, respectively, in accordance with one or more particular embodiments. The aperture opening 550 of FIG. 5 is the horizontal distance from the horizontal center 552 of LED-based optically indirect recessed luminaire 100 that the reflected light reaches. The line of sight 660 of FIG. 6 is the distance that the LEDs 314 extend above the top of the heat sink 310 when looking at the LED light source platform 106 from a side view. In a particular embodiment, the line of sight 660 between the top-most portion of the LEDs 314 and the bottom aperture of the reflector defines the top portion of the heat sink 310.

Figure 7:
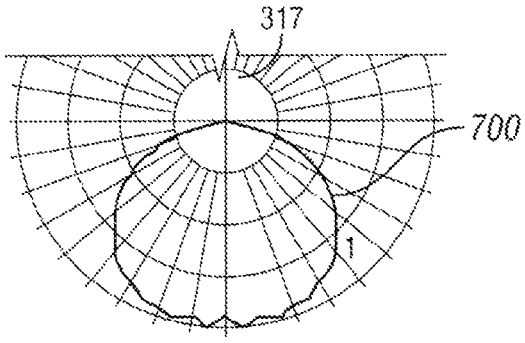
FIG. 7 shows a photometric distribution of light emitted from an LED-based optically indirect recessed luminaire in accordance with one or more particular embodiments.

FIG. 7 shows a photometric distribution 700 of light emitted from an LED-based optically indirect recessed luminaire in accordance with one or more particular embodiments. Specifically, FIG. 7 shows a favorable photometric distribution that provides substantial task lighting while also softly illuminating vertical surfaces within a space. As a result, there is no "cave effect" that commonly occurs using other shielding type optics, including but not limited to parabolic troffers.

FIGS. 8A through 8D show an LED-based indirect recessed luminaire 102 integrated as a door assembly in accordance with one or more particular embodiments. Specifically, FIGS. 8A through 8D show that the LED-based indirect recessed luminaire 102 may include one or more hinges 810 on one side of the bottom aperture of the reflector 104. In this example, the hinge 810 is coupled along the length of the reflector 104, but the hinge may also be coupled along the width of the reflector 104. The hinge 810 may also couple to a corresponding side of a housing 820 so that the reflector 104 may swing downward, away from the housing 820, for easier installation, maintenance, cleaning, repair, and/or any other suitable function. For example, the housing 820 may be an architectural coffer.

In a particular embodiment, a side of the housing 820 and/or a side of the reflector 104 opposite the hinge 810 may include one or more fastening devices and/or fastening receivers to allow the reflector 104 to be fixedly and/or removeably coupled to the housing 820. Examples of fastening devices and fastening receivers may include, but are not limited to, moveable clips that are accommodated by corresponding slots, screws that are accommodated by corresponding threaded apertures, and snaps that are accommodated by snap receivers.

Figure 8A:
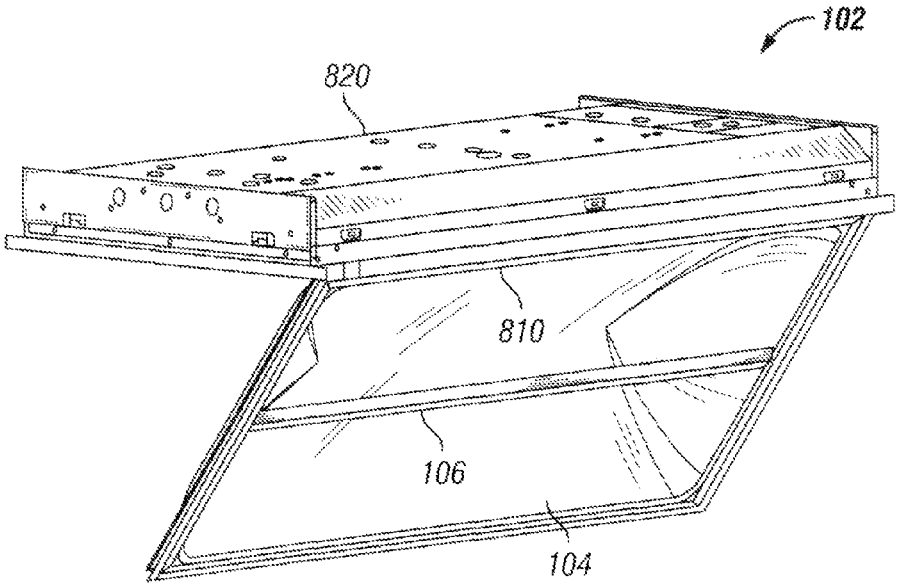
FIGS. 8A through 8D show an LED-based indirect recessed luminaire integrated as a door assembly in accordance with one or more particular embodiments.
Figure 8B:
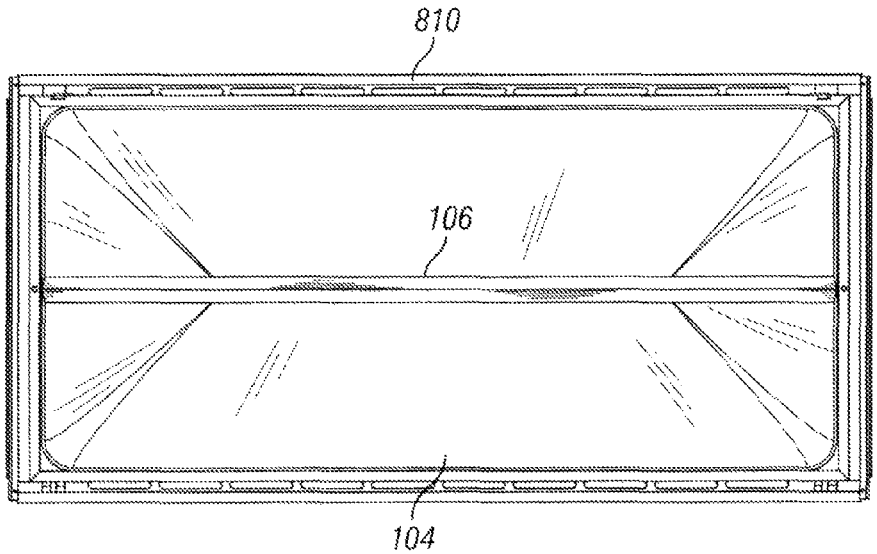
Figure 8C:
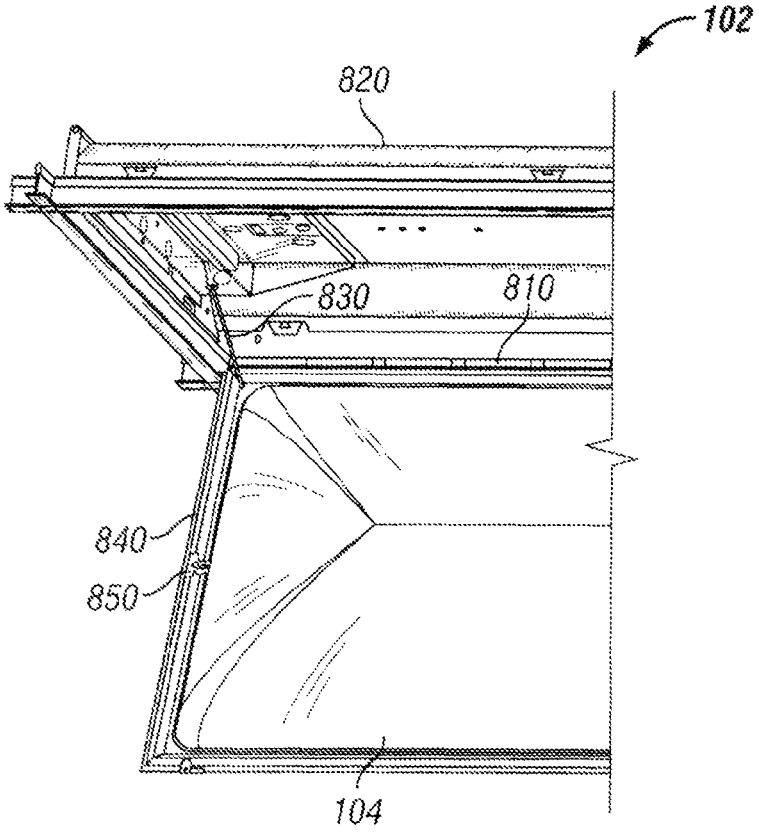
Figure 8D:
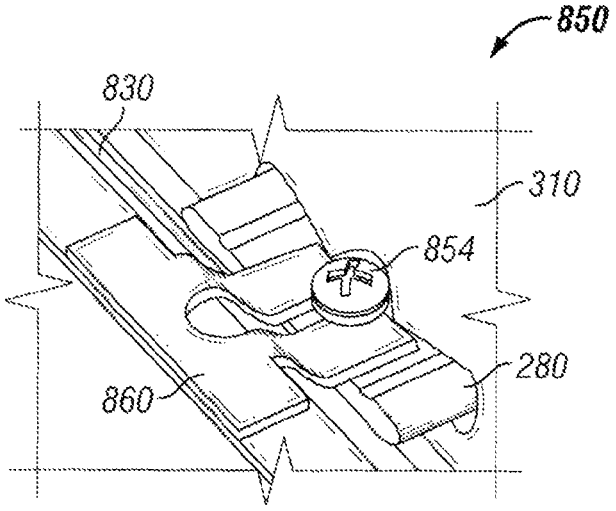

As shown in FIGS. 8C and 8D, a wire harness 840 integrated with or coupled to at least a portion of an edge of the bottom aperture of the reflector 104 is configured to house wiring 830 from the housing 820. Further, a wiring connection 850 may be located proximate to an end of the wire harness 840 opposite the hinge 810. In such a case, the wiring connection 850 may be configured to provide power and/or control from the wiring 830 to the PCB using a coupling device 860 coupled to the PCB. The wiring connection 850 and the wiring 830 may be electrically coupled using one or more of a number of methods, including but not limited to soldering, a terminal block, and a compression fitting.

FIG. 8D also shows a fastening device 854 that is configured to couple the coupling device 860 to the support bracket 280, where the heat sink 310 (as well as, potentially, other elements of the LED light source platform) is coupled to the support bracket 280. In particular embodiments, the coupling device 860 is used to provide electrical and/or mechanical connectivity between the wiring 830 and the PCB. Alternatively, or in addition, the coupling device 860 may include a disconnect or other safety features. For example, when the LED-based indirect recessed luminaire 102 is released to swing downward, away from the housing 820, the coupling device 860 may disconnect the power and/or control signals feeding from the wiring 830 to the PCB. In such a case, a user may perform one or more tasks (e.g., cleaning, maintenance, repair) on the LED-based indirect recessed luminaire 102 without risk of shock or other injury caused by the power and/or control signals.

In one or more embodiments, the LEDs of the arrays of the LED-based optically indirect recessed luminaire may be driven by an external LED driver. Alternatively, LED driver circuitry may be incorporated into the PCB and/or heat sink. In such a case, the heat sink may be configured to dissipate the thermal load of both the LEDs and the LED driver circuitry. In such a case, the LED-based optically indirect recessed luminaire may be connected directly to an alternating-current circuit. Further, the particular embodiments shown and described herein use natural air flow for heat dissipation. Specifically, with no lens, cover, door, or other enclosure, the heat sink is open to the space in which the LED-based optically indirect recessed luminaire is located.

While the LED-based optically indirect recessed luminaires shown and described above are linear in shape, other shapes may be used in one or more embodiments. For example, an LED-based optically indirect recessed luminaire may be curved in two or three dimensions. Further, LED-based optically indirect recessed luminaires (including one or more of its components) may be of any length, width, and/or depth.

The particular embodiments of the LED-based optically indirect recessed luminaires described herein allow relatively inexpensive modules that are easy to install. Further, the particular embodiments of the LED-based optically indirect recessed luminaires effectively mix different color LEDs together for improved efficacy. Particular embodiments of the LED-based optically indirect recessed luminaires also provide for aesthetically attractive fixtures without complexity of design and construction. Further, the example LED-based optically indirect recessed luminaires described herein are thermally managed to meet lifetime and/or light output requirements.

Further, the embodiments of LED-based optically indirect recessed luminaires described herein allow for fewer LEDs, both now and in the future, without changing (or improving) the optics of such luminaires. For example, as LEDs improve over time, such improved LEDs may be used with the LED-based optically indirect recessed luminaires without redesigning such luminaires.

Particular embodiments described herein also allow for easy retrofitting and/or installation. For example, the use of the hinges and a door assembly may make retrofitting an LED-based indirect recessed luminaire into a pre-existing housing or architectural coffer easier. The use of hinges and a door assembly also ease new construction and installation of LED-based indirect recessed luminaires. Using a door assembly makes maintenance easier and safer because, as the reflector swings away from the housing or architectural coffer, a ladder may not be needed to reach elements of the LED-based indirect recessed luminaire.

In addition, LED-based optically indirect recessed luminaires allow for uniform illumination (i.e., no or minimal "dead zones," "cave effect," and/or light output fluctuations) across the length of the LED-based optically indirect recessed luminaires and operate at efficient levels. Further, because of the use of LEDs, less energy may be consumed by the embodiments of the LED-based optically indirect recessed luminaires described herein.

Accordingly, many modifications and other embodiments set forth herein will come to mind to one skilled in the art to which LED-based optically indirect recessed luminaires pertain having the benefit of the teachings presented in the foregoing descriptions and the associated drawings. Therefore, it is to be understood that LED-based optically indirect recessed luminaires are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light emitting diode (LED)-based optically indirect luminaire, comprising:

a reflector recessed into a ceiling; and an LED light source platform disposed below a portion of the reflector and extending along a longitudinal axis of the reflector, the LED light source platform comprising a plurality of LEDs disposed on the LED light source platform, wherein the LED light source platform is disposed between a first longitudinal side of the reflector and a second longitudinal side of the reflector and wherein the reflector is continuous between the first longitudinal side and the second longitudinal side;

wherein the LED light source platform shields the plurality of LEDs from view with respect to a space to be illuminated by the LED-based optically indirect luminaire; and wherein substantially all of a light emitted by the plurality of LEDs is directed toward the reflector.

2. The LED-based optically indirect recessed luminaire of claim 1, further comprising at least one support coupled to the reflector, wherein the at least one support has a first end coupled to the reflector and a second distal end coupled to the LED light source platform.

3. The LED-based optically indirect recessed luminaire of claim 1, wherein the LED light source platform is coupled to at least one longitudinal end of the reflector.

4. The LED-based optically indirect recessed luminaire of claim 3, further comprising a support bracket disposed on the at least one longitudinal end of the reflector and coupled to the LED light source platform.

5. The LED-based optically indirect luminaire of claim 1, wherein the plurality of LEDs are positioned linearly along a full length of the LED light source platform.

6. The LED-based optically indirect luminaire of claim 1, wherein the plurality of LEDs are clustered at one or more segments of the LED light source platform.

7. The LED-based optically indirect luminaire of claim 1, wherein the reflector is a diffuse reflector.

8. The LED-based optically indirect luminaire of claim 1, wherein the LED light source platform comprises a heat sink and a printed circuit board (PCB).

9. The LED-based optically indirect luminaire of claim 8, wherein the heat sink and the PCB shield the plurality of LEDs from view with respect to the space to be illuminated by the LED-based optically indirect luminaire.

10. The LED-based optically indirect luminaire of claim 9, further comprising a lens positioned over a portion of the heat sink, over the plurality of LEDs, and over a surface of the PCB facing the reflector.

11. The LED-based optically indirect luminaire of claim 9, further comprising a decorative cover surrounding a portion of the heat sink, wherein an outer surface of the cover faces toward the space to be illuminated by the LED-based optically indirect luminaire.

12. A light emitting diode (LED)-based optically indirect luminaire, comprising:

a reflector recessed into a ceiling; and an LED light source platform disposed below a portion of the reflector and extending along a longitudinal axis of the reflector, wherein the LED light source platform is disposed between a first longitudinal side of the reflector and a second longitudinal side of the reflector and wherein the reflector is continuous between the first longitudinal side and the second longitudinal side, the LED light source platform comprising:

a printed circuit board (PCB);

a plurality of LEDs disposed on the PCB; and a heat sink coupled to the PCB, wherein the heat sink and the PCB shield the plurality of LEDs from view with respect to area below the LED-based optically indirect luminaire.

13. The LED-based optically indirect recessed luminaire of claim 12, further comprising at least one support coupled to the reflector, wherein the at least one support has a first end coupled to the reflector and a second distal end coupled to the LED light source platform.

14. The LED-based optically indirect luminaire of claim 13, wherein the LED light source platform is shorter than the reflector.

15. The LED-based optically indirect recessed luminaire of claim 12, wherein the LED light source platform is coupled to at least one longitudinal end of the reflector.

16. The LED-based optically indirect recessed luminaire of claim 12, wherein the plurality of LEDs are oriented to emit light toward the reflector.

17. A light emitting diode (LED)-based optically indirect luminaire, comprising:

a reflector recessed into a ceiling;

an LED light source platform disposed below a portion of the reflector and extending along a longitudinal axis of the reflector, the LED light source platform comprising a plurality of LEDs disposed on the LED light source platform, wherein the LED light source platform is disposed between a first longitudinal side of the reflector and a second longitudinal side of the reflector and wherein the reflector is continuous between the first longitudinal side and the second longitudinal side; and a housing, wherein the reflector is attached to the housing via a hinge and wherein the reflector is configured to swing at the hinge.

18. The LED-based optically indirect recessed luminaire of claim 17, wherein wiring from the housing is provided to the LED light source platform along an edge of the reflector.

19. The LED-based optically indirect recessed luminaire of claim 18, further comprising a coupling device configured to disconnect the wiring from a printed circuit board coupled to the LEDs when the reflector swings away from the housing.

20. The LED-based optically indirect luminaire of claim 17, further comprising a sensor coupled to the LED light source platform.

* * * * *